United States Patent [19]

Scott

[11] Patent Number: 4,759,307

[45] Date of Patent: Jul. 26, 1988

[54] TANKER BALLAST

[75] Inventor: Thomas J. Scott, Wallingford, Pa.

[73] Assignee: Sun Transport, Inc., Aston, Pa.

[21] Appl. No.: 36,538

[22] Filed: Apr. 9, 1987

[51] Int. Cl.[4] ..... B63B 25/08

[52] U.S. Cl. ..... 114/74 R; 114/121; 114/125

[58] Field of Search ..... 114/74 R, 121, 122, 114/124, 125, 333

[56] References Cited

U.S. PATENT DOCUMENTS

| | | | |
|---|---|---|---|
| 688,398 | 12/1901 | Dodge | 114/125 |
| 3,318,278 | 5/1967 | Huebotter | 114/125 |
| 3,478,711 | 11/1969 | Combs | 114/333 |
| 3,543,711 | 12/1970 | Peters | 114/125 |
| 3,559,609 | 2/1971 | Sydow | 114/125 |
| 3,771,485 | 11/1973 | Brunsell | 114/125 |
| 3,804,050 | 4/1974 | Iarossi | 114/121 |
| 3,938,457 | 2/1976 | Dwyer | 114/74 R |
| 4,014,280 | 3/1977 | Laxo | 114/124 |
| 4,604,960 | 8/1986 | Wachi | 114/121 |

OTHER PUBLICATIONS

Ballast Tankers, U.S. Maritime Administration, PB298 825, Oct. 1978.

*Primary Examiner*—Joseph F. Peters, Jr.
*Assistant Examiner*—Stephen P. Avila
*Attorney, Agent, or Firm*—J. Edward Hess; Donald R. Johnson

[57] ABSTRACT

In order to reduce the economic impact of segregated ballast requirements for tanker vessels, heavy ballast, for example concrete, is placed in the segregated ballast tanks in amount to occupy 30 to 50% of the free volume of the tank. The rest of the tank may be filled with water ballast. The use of heavy ballast provides a total ballast weight equal to that obtainable with a greater number of tanks filled with water ballast only, thus increasing the available cargo space.

2 Claims, 2 Drawing Sheets

TANKER BALLAST

Figures 1, 2, 3:
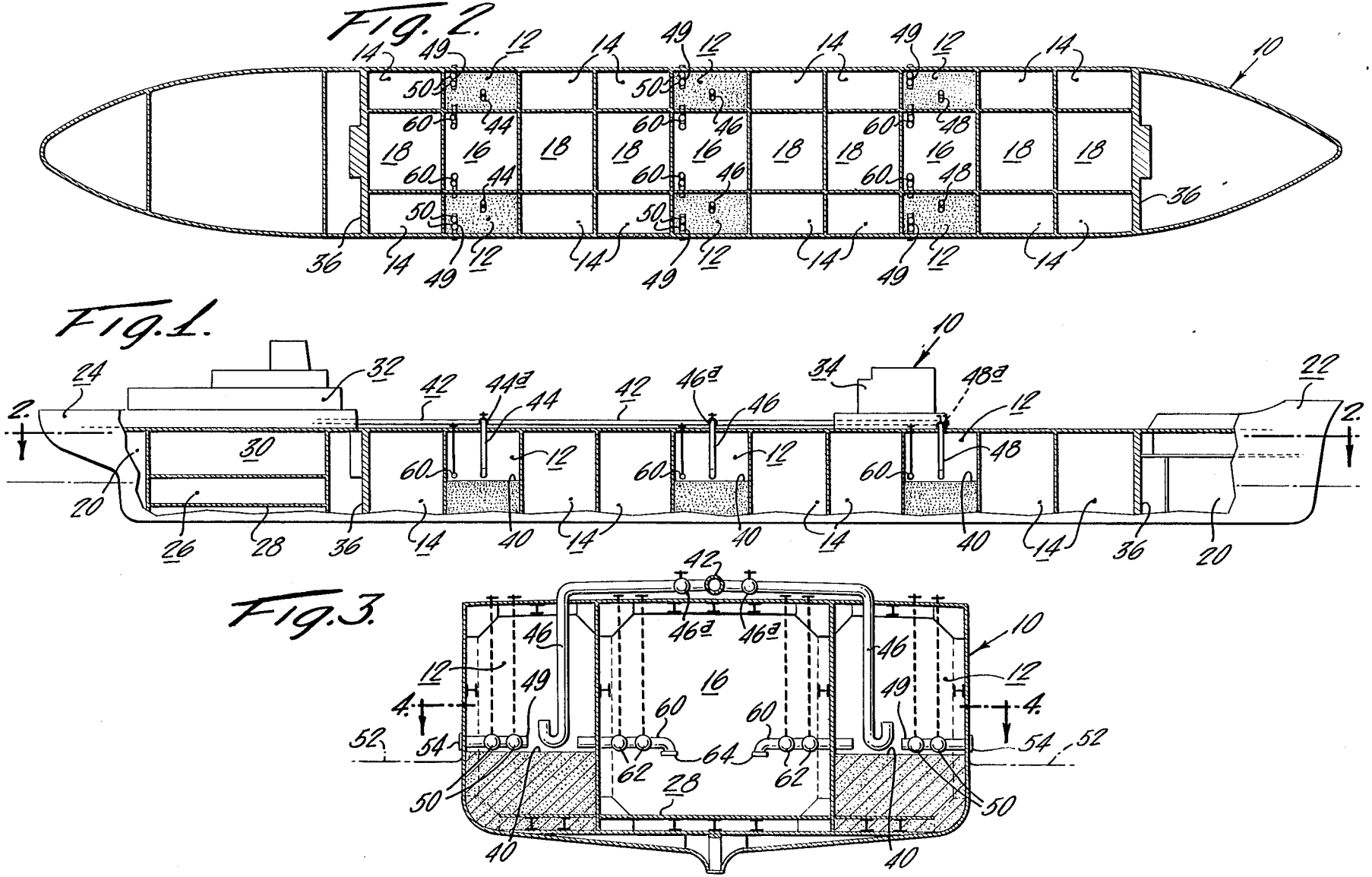

This invention relates to ocean going tanker vessels that transport liquid such as crude petroleum or refined products or other cargoes, and to ballast materials for such vessels.

In the past, tankers have used water ballast in cargo oil tanks from which the oil had previously been discharged. However, regulations have in recent years been adopted which prevent the discharge of oily ballast water into the sea and require that ballast seawater be carried in segregated ballast tanks in which oil has not previously been carried. Ballasting in this manner becomes an added operational expense because the segregated tanks constitute a reduction in space available for transporting cargo.

U.S. Pat. No. 3,938,457 addresses this problem by cutting away a portion of the lower part of the hull of the tanker to reduce its buoyancy, thereby requiring less ballast in order to provide the desired draft of the vessel. This patent also discloses that fixed ballast heavier than water can be installed in the tanker in order to reduce the required volume of ballast.

U.S. Pat. No. 3,804,050 uses preformed concrete slabs, distributed throughout and secured in place in the midbody of the tanker in order to provide a permanent ballast arrangement for externally insulated tankers.

U.S. Pat. No. 3,318,278 discloses the ballasting of ships carrying containerized cargo by placing in the ballast tanks thereof a higher density fluid having proper rheological properties.

U.S. Pat. No. 3,543,711 discloses ballasting of vessels, for example carriers of containerized freight, by introducing a flowable, inert, inorganic ballast composition into a ballast space.

U.S. Pat. No. 3,559,609 discloses ballasting of vessels, for example carriers of containerized cargo, by introducing a fluidized, substantially liquid free composition containing a subdivided mineral weighting agent.

In "Arrangement and Structural Study for Very Large Crude Carriers (VLCC) Segrated Ballast Tankers Executive Summary", U.S. Maritime Administration, PB298 825, October 1978, the economic impact of the 1973 Marine Pollution Conference segregated ballast requirements is assessed, and the use of solid ballast (concrete) to reduce the amount of cargo lost to segregated ballast tanks is disclosed. In the drawing entitled "Cargo Space Arrangement Configuration E-2" on page A-23, in that publication, four ballast tanks are shown with concrete in the bottoms thereof to a height about 20% of the height of the tank. In the drawing entitled "Cargo Space Arrangement Configuration H-2", on page A-25 in that publication, six ballast tanks are shown with concrete in the bottoms thereof to varying heights, all less than 25% of the height of the tank.

The present invention provides a means by which the economic impact of the segregated ballast requirements may be reduced, while obtaining certain other advantages over prior measures disclosed for this purpose. This is done for a given tanker by reducing the number of tanks which are dedicated to ballast and not used for cargo. In the tanks which are dedicated to ballast, a ballast material (heavy ballast) of higher density than seawater is placed to occupy a portion of the volume of the tank. The remainder of the tank is used for water ballast in the usual manner.

The heavy ballast occupies about 30 to 50% of the free volume of the ballast tank. The free volume is that volume otherwise available for filling with liquid, exclusive of structural members such as longitudinals, stringers and webs.

By providing heavy ballast which occupies a greater portion of the free volume of the ballast tank than in the prior art, the draft of the vessel in the light-ship condition is greater than in the prior art, with resulting advantages as herein set forth.

The level of the heavy ballast in the ballast tanks is at least approximately as high as the light-ship draft of the vessel, so that the top level of the heavy ballast is approximately at or above the water line, so that water may be drained by gravity from the space above the heavy ballast in the ballast tanks. The amount of heavy ballast in the ballast tanks is balanced on each side of the vessel and is generally uniform from fore to aft, although it can be varied somewhat for such purposes as maintenance of a stern trim if desired.

Suitable ballast materials for use according to the invention include concrete and Ballast-Crete ®, a combination of inorganic, non-toxic, granular and thixotropic fines mixed with water. Ballast-Crete, a product of Genstar Stone Products Company of Hunt Valley, Md., is a flowable, water-retentive substance during installation, resembling ready mixed concrete; after vessel placement, it firms to a semi-solid mass.

The invention will be further described with reference to the drawings in which:

FIG. 1. is a side elevational view of tanker of this invention, with a major portion of its hull broken away and in section to more clearly show certain details of its construction.

FIG. 2. is a sectional plan view taken on the line 2, 2 of FIG. 1. showing additional details of construction.

FIG. 3. is an enlarged transverse sectional view taken on the line 3, 3 of FIG. 1 showing in greater detail the ballast tank and the heavy ballast therein.

Figure 4:
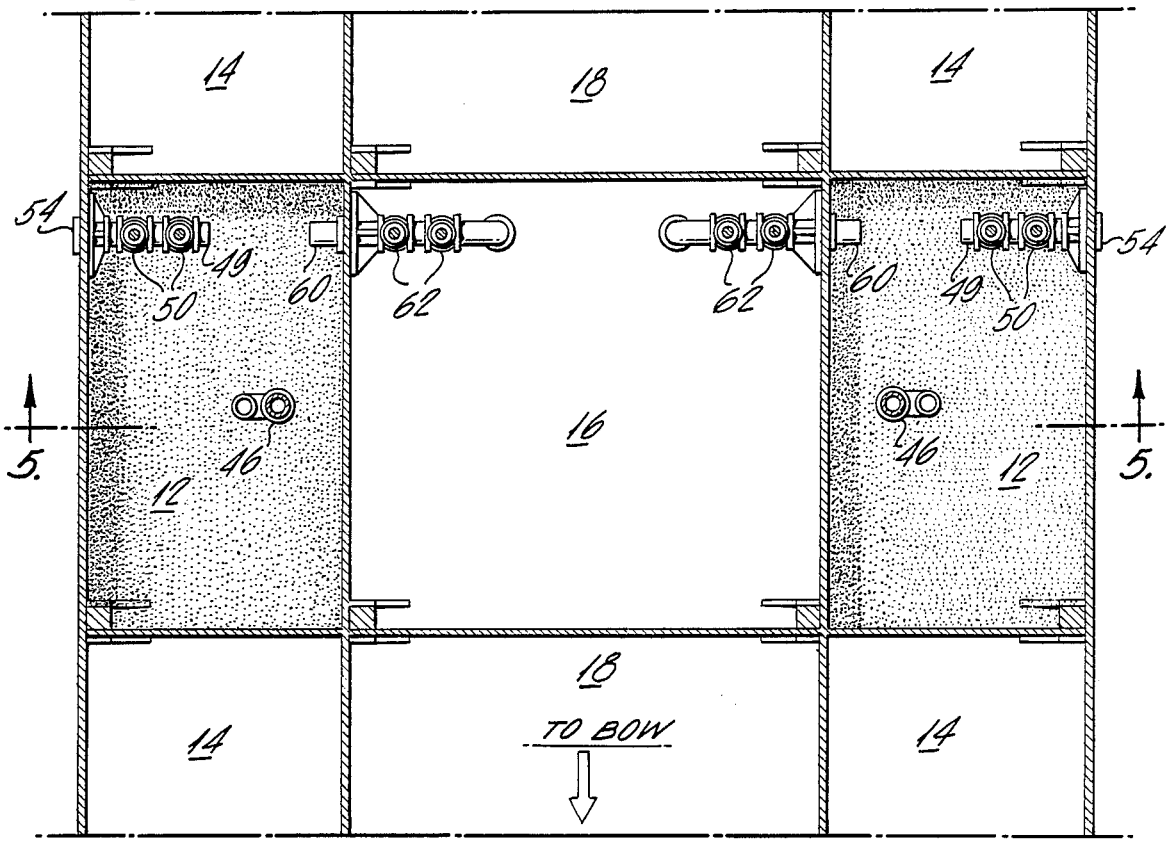

FIG. 4. is an enlarged fragmentary sectional plan view taken on the line 4, 4 of FIG. 3 showing the valving in greater detail.

Figure 5:
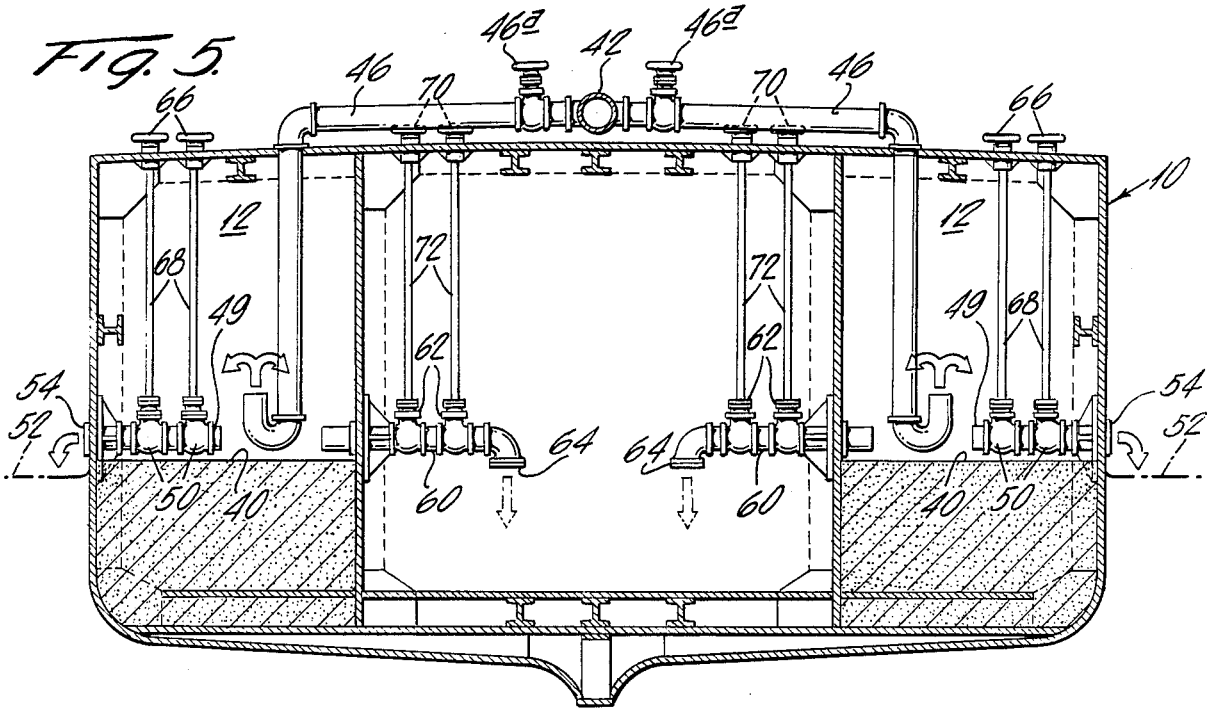

FIG. 5. is a sectional elevational view taken on the line 5, 5 of FIG. 4.

Referring to FIGS. 1 and 2, tanker 10 has segregated ballast tanks 12 and wing cargo tanks 14. The center tanks in this embodiment are all cargo tanks 16 and 18. The tanker has fuel tanks 20 at the bow 22 and stern 24. At the stern 24, in addition to conventional propulsion and steering means not shown, the tanker has engine room 26 and inner bottom 28, utility area 30 and crew area 32. The boatswain's store area is shown at 34 and cofferdams at 36. The ballast tanks 12 are filled with concrete to the level 40. The space above level 40 in each tank 12 is available for water ballast, which can be pumped in and drained out in order to maintain the proper draft of the tanker.

Water is introduced into the ballast tanks through lines 42, 44, 46 and 48 from a source, not shown, in utility area 32, using valves **44*a*, 46*a* and 48*a* in lines 44, 46 and 48 respectively. Water is removed from the ballast tanks through lines 49**.

In the light-ship condition, with ballast water in ballast tanks 12, the water line 52 is below the outlet 54 of line 49 and slightly below the level 40 of the solid ballast in the ballast tanks. Ballast water is removed at the desired times from the space above the solid ballast in the ballast tank 12, by opening valves 50 in lines 49 to allow water to drain from the space into the water around the ship. Positioning of the top of the heavy ballast at least approximately as high as the light-ship draft enables ballast water to be drained without pipe line additions through bulkheads and without need for further pump installation. When the vessel is being filled with cargo, the valves 50 in lines 49 are closed, so that as the water level rises, water does not flow into the ballast tanks 12.

The outlets 54 in lines 49 are shown as flush with the side of the ship and may advantageously be provided with suitable covers of known type, not shown. The valves 50 will typically be actuated by valve wheels on the deck above, connected to the valves by reach rods. For safety, each of the valves 50 as shown may be two valves in series, each with a valve wheel and reach rod.

Referring to FIGS. 3 and 4, in order to provide means for cleaning the ballast tanks, for example to prepare for welding in order to repair a leak, lines 60 are provided, with valves 62 therein, and blanked flanges 64. In order to clean the ballast tanks, the flanges are removed, the ballast tanks cleaned, and the run-off from the ballast tanks passes through the lines 60 into the cargo tank, from which it is removed to a slop tank not shown through conventional piping for cargo tanks. The valves 62 will typically be actuated by valve wheels on the deck above, connected to the valves by reach rods. For safety, each of the valves 62 as shown may be two valves in series, each with a valve wheel and reach rod.

Referring to FIG. 5, the valves 50 are provided with valve wheels 66 and reach rods 68, and the valves 60 are provided with valve wheels 70 and reach rods 72.

In an example of the construction according to the invention, the height of the tank is about 48 feet and the height of concrete in the tank is about 16 feet. Since the concrete is about 2.3 times as heavy as seawater, the weight of the concrete, if the free space in the tank were uniform from top to bottom, would be about 53% of the combined weight of concrete and water in the tank when full. However, because of the volume of structural members and curvature of the tank bottom, the weight of the concrete is about 50% of the combined weight of concrete and water in the tank when full. Obviously, if the tank were uniform from top to bottom, the concrete would occupy one-third of the volume of the tank. However, because of the volume of structural members and the curvature of the tank bottom, the concrete occupies slightly more than one-third, perhaps about 35%, of the free volume of the tank.

The invention claimed is:

1. A tanker vessel having ballast tanks partly filled with heavy ballast material of a higher density than seawater, said heavy ballast occupying about 30 to 50% of the free volume of the ballast tank, said tanks being adapted to be further filled with water above the heavy ballast material to provide a total ballast weight equal to that obtainable with a greater number of tanks filled with water ballast only, thereby increasing the cargo space available in the vessel, said ballast tanks extending above and below the light-ship draft of the vessel and having outlets to the exterior of said vessel positioned above the top of the heavy ballast and above the light-ship draft of the vessel, so that water ballast may be removed by gravity through said outlets.

2. Vessel according to claim 1 and additionally comprising means for draining liquid from the space above the top of the heavy ballast into an adjacent cargo tank.

* * * * *